US006313818B1

(12) United States Patent
Kondo et al.

(10) Patent No.: US 6,313,818 B1
(45) Date of Patent: Nov. 6, 2001

(54) ADJUSTMENT METHOD FOR ACTIVE-MATRIX TYPE LIQUID CRYSTAL DISPLAY DEVICE

(75) Inventors: Junji Kondo, Kanagawa-ken; Sachiko Kuroishi; Sakae Yoshida, both of Hyogo-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 08/870,001

(22) Filed: Jun. 5, 1997

(30) Foreign Application Priority Data

Jun. 7, 1996 (JP) ..... 9-145354
May 5, 1997 (JP) ..... 9-138075

(51) Int. Cl.[7] ..... G09G 3/36
(52) U.S. Cl. ..... 345/89; 345/96
(58) Field of Search ..... 345/89, 77, 87, 345/147, 96, 94, 148, 209, 92

(56) References Cited

U.S. PATENT DOCUMENTS 5,185,602 * 2/1993 Bassetti, Jr. et al. ..... 340/793
5,194,974 * 3/1993 Hamada et al. ..... 359/59
5,293,159 * 3/1994 Bassetti, Jr. et al. ..... 345/149
5,475,396 * 12/1995 Kitajima et al. ..... 345/92
5,841,410 * 11/1998 Oda et al. ..... 345/58
5,844,538 * 12/1998 Shiraki et al. ..... 345/98
5,844,540 * 12/1998 Terasaki ..... 345/102
5,856,814 * 1/1999 Yagyu ..... 345/89
5,956,007 * 9/1999 Ito et al. ..... 345/89
5,959,598 * 9/1999 McKnight ..... 345/90
6,011,530 * 1/2000 Kawahata et al. ..... 345/90

* cited by examiner

*Primary Examiner*—Bipin Shalwala
*Assistant Examiner*—Vanel Frenel
(74) *Attorney, Agent, or Firm*—Oblon, Spivak, McClelland, Maier & Neustadt, P.C.

(57) ABSTRACT

An adjustment method for active-matrix type liquid crystal display device adjusts the potential differences applied to liquid crystal layers in such a way that black images are displayed in one group of pixels with the same polarity of the potential difference during a single vertical scanning period while halftone images are displayed in another group of pixels with the same polarity of the potential difference during the single vertical scanning period.

15 Claims, 19 Drawing Sheets

FIG. 15(a)
PRIOR ART

| | | | | | | | | |
|---|---|---|---|---|---|---|---|---|
| L1 | + | + | + | + | + | + | + | + |
| L2 | − | − | − | − | − | − | − | − |
| L3 | + | + | + | + | + | + | + | + |
| L4 | − | − | − | − | − | − | − | − |
| L5 | + | + | + | + | + | + | + | + |
| ⋮ | | | | | | | | |
| L240 | − | − | − | − | − | − | − | − |

FIG. 15(b)
PRIOR ART

| | | | | | | | | |
|---|---|---|---|---|---|---|---|---|
| L1 | − | − | − | − | − | − | − | − |
| L2 | + | + | + | + | + | + | + | + |
| L3 | − | − | − | − | − | − | − | − |
| L4 | + | + | + | + | + | + | + | + |
| L5 | − | − | − | − | − | − | − | − |
| ⋮ | | | | | | | | |
| L240 | + | + | + | + | + | + | + | + |

FIG. 16(a)
PRIOR ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 16(b)
PRIOR ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG. 17(a)
PRIOR ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

FIG. 17(b)
PRIOR ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

ADJUSTMENT METHOD FOR ACTIVE-MATRIX TYPE LIQUID CRYSTAL DISPLAY DEVICE

BACKGROUND OF THE INVENTION

1. Technical Field of the Invention

This invention relates to an adjustment method for an active-matrix type liquid crystal display device with multiple pixels arranged in a matrix of columns and rows.

2. Related Art

In recent years, because of their thinness, light weight and low power consumption, matrix type liquid crystal display devices have been used in various fields such as display devices for personal computers and word processors, TV display devices, and also projection type display devices.

Amongst these, active-matrix liquid crystal display devices include switching elements electrically connected to pixel electrodes to drive liquid crystal layers and achieve fine display images without cross-talk between neighboring pixels. Therefore, research and development of these devices has been vigorously carried out.

However, in such an active-matrix type liquid crystal display device, when a DC voltage is applied to the liquid crystal layer for a long time, this leads to deterioration of the liquid crystal material and makes it difficult to keep display images in good quality for a long period of times. To avoid these technical difficulties "frame reversal drive" is used. Generally, at every single vertical scanning period it reverses the polarities of potential differences (voltages) to be applied to the liquid crystal layers through pixel and counter electrodes therebetween.

Also, to prevent flickering of the display screen, the technique of reversing the polarities of potential differences applied to the liquid crystal layers at every single vertical scanning period and, at the same time, reversing the same every pixel or every scanning line has become known through, for instance, Japanese Laid-Open Patent Application Nos. 61-275822 and 62-218943.

In short, as shown in FIG. 15(*a*) and (15*b*), a "horizontal (H) line reversal driver" is used in which, in addition to the reversal of the polarities of the potential differences applied to the liquid crystal layers (through pixel and counter electrodes connected therebetween) every single vertical scanning period, the polarities of the potential differences applied to the liquid crystal layers are also reversed at every single horizontal pixel line or every multiple of neighboring horizontal pixel lines. Also, as shown in FIG. 16(*a*) and 16(*b*), a "vertical (V) line reversal drive" is used in which, in addition to the reversal of the polarities of the potential differences applied to the crystal layers at every single vertical scanning period, the polarities of the potential differences applied to the liquid crystal layers are also reversed at every single vertical pixel line or every multiple of neighboring vertical pixel lines. Further, as shown in FIGS. 17(*a*) and 17(*b*), a "dot (HV) reversal drive" is used in which, in addition to the reversal of the polarities of the potential differences applied to the crystal layers every single vertical scanning period, the polarities of the potential differences applied to the liquid crystal layers are also reversed at every single pixel or every multiple of neighboring pixels.

As shown in FIG. 18, a pixel electrode E of a liquid crystal layer is connected to a thin-film transistor (hereafter abbreviated as "TFT") in the vicinity of the crossing of signal line Xi and scanning line Yj for every pixel of an active-matrix type liquid crystal display device. Counter electrode C of the liquid crystal layer is disposed opposite to this pixel electrode E. Moreover, in order to suppress the fluctuation of the pixel electrode voltage, supplementary electric capacitor Cs is connected in parallel with equivalent electric capacitor Clc to the liquid crystal layer (a reference voltage is supplied to line CS connected to the capacitor Cs).

With this structure, a parasitic electric capacitance Cgs unavoidably exists between the gate and source electrodes of the TFT and also between signal line X and pixel electrode E. For this reason, when the TFT operates as n-type, pixel electrode voltage Ve is applied to parasitic capacitance Cgs simultaneously with the turning off of the TFT, and pixel electrode voltage Ve shifts level to the negative side. In the event that the TFT operates as p-type however, the voltage polarity thereof is reversed in the present case.

A positive polarity is when the pixel electrode voltage is higher than the counter electrode voltage while a negative polarity is when the pixel electrode voltage is lower than the counter electrode voltage.

To prevent from flickering and applying DC voltage to the liquid crystal layers and to keep display images in good quality, relative potential differences between counter voltage Vcom and image signal voltage Vsig should be determined essentially in consideration of level shift at the pixel electrode resulting from the stray capacitance Cgs.

Such level shift depends on the values of equivalent liquid crystal capacitor Clc, supplementary capacitor Cs and parasitic capacitance Cgs which vary from product to product. As a result, relative potential differences between counter electrode voltage Vcom and video signal voltage Vsig cannot be precisely determined in advance through engineering design.

Therefore, normally, adjustment is performed visually to reduce flicker by an operator in a state in which an image of the same brightness is displayed over the whole screen. However, in the above active-matrix type liquid crystal display devices which are V-line reversal driven, H-line reversal driven or HV-reversal driven, compared with normal frame-reversal drive, the drive is such that the polarity reversal cycle is short and flicker is hardly noticeable. Therefore, strict visual adjustment is difficult.

For this reason, although there appears to be no flicker problem with the displayed image, the liquid crystal layer will receive DC voltage for a long time due to improper adjustment of the positive and negative potential differences. Therefore, the variation in life span occurs from product to product.

SUMMARY OF INVENTION

This invention overcomes the above technical problems. One object of the present invention is to provide an adjustment method for flicker suppressible, V-line reversal driven, H-line reversal driven or HV reversal driven active-matrix type liquid crystal display devices in which the application of a DC voltage over a long period on the liquid crystal layer is reduced and good quality images can be displayed for a long period of time. Another object of the invention is to provide an adjustment method for active-matrix liquid crystal display devices in which its variation is less from product to product.

An adjustment method for an active-matrix type liquid crystal display device displays images on pixels provided in matrix of rows and columns of a display panel with the intensity variable first and second brightness in response to potential differences applied to liquid crystal layers through pixel and counter electrodes thereof, the first brightness being less in intensity than the second brightness; changes the polarities of the potential differences every pixel or every multiple of pixels in at least one vertical scanning period; applies to the liquid crystal layers of a first group of pixels the potential differences with the intensity of the first or second brightness and the same polarity during the vertical scanning period; sets the potential differences with the intensity of third brightness and the same polarity on a second group of the pixels during the vertical scanning period; and adjusts the potential difference in accordance with the images of at least the third brightness which is halftone or intermediate in intensity between the first and second brightness.

According to the adjustment method of the present invention, the first and second groups of pixels display images with the intensity of the first or second brightness and the third brightness, respectively, in response to the potential it differences applied to the liquid crystal layers.

In the active-matrix type liquid crystal display device a very little brightness change, if any, takes place with absolute value fluctuations in the potential difference applied between the pixel and counter electrodes of liquid crystal layer in the maximum and minimum brightness regions of voltage-brightness characteristics as shown in FIG. 19. Sharp brightness changes occur, however, with those of the potential differences in intermediate brightness region. Since an adjustment of potential differences is carried out by displaying black and halftone images, for instance, the adjustment method of the present invention can detect appropriately fluctuations of potential difference for the halftone images.

In addition, in the halftone display pixel group, the potential difference is the same in polarity for one vertical scanning period so that an operator (or an optical sensor) easily detects the halftone display as if its image frequency were essentially reduced in the same degree as the drive in which the polarity of potential differences applied to each pixel is the same during such one vertical scanning period.

In other words, the halftone display image can be easily recognized as if an adjustment operation frequency were reduced. By this means, even with an active-matrix type display device in which the occurrence of flicker is sufficiently suppressed by V-line reversal drive, H-line reversal drive or HV reversal drive, it is easy to carry out an adjustment operation and it is possible to prevent a DC voltage from being applied between the pixel and counter electrodes for a long time so that good quality display can be maintained.

In order to to improve the detectability of flicker, the intermediate of halftone brightness is set to be 30 through 70, preferably 35 through 45, in relative intensity on such conditions that the maximum and minimum brightness are 100 and 0 in relative intensity. Importantly, the maximum and minimum brightness, e.g., white and black colors, respectively, are in such characteristics that a little change in brightness takes place with absolute value fluctuations of potential difference applied to the liquid crystal layers. However, they are not necessarily white and black colors because green and blue colors may be used for the same purpose, respectively.

BRIEF DESCRIPTION OF THE DRAWINGS

FIGS. 15(*a*) and 15(*b*) are schematic image display diagrams on first and second frames of the horizontal scanning line reversal drive, respectively;

FIGS. 16(*a*) and 16(*b*) are schematic image display diagrams on first and second frames of the vertical scanning line reversal drive, respectively;

FIGS. 17(*a*) and 17(*b*) are schematic image display diagrams on first and second frames of the dot reversal drive, respectively;

DESCRIPTION OF THE PREFERRED EMBODIMENT

Figure 1:
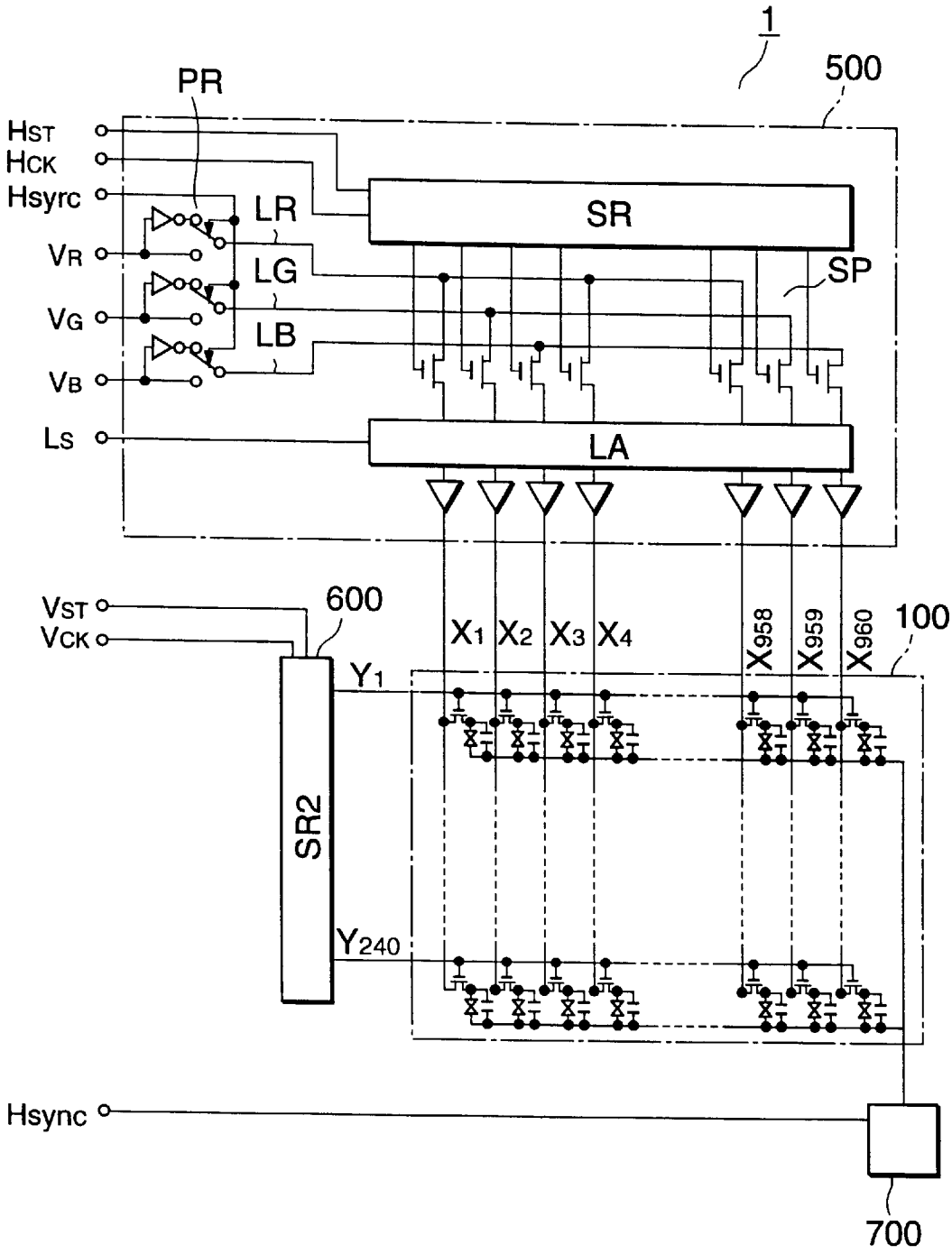
FIG. 1 is a block diagram of an embodiment of the active-matrix type liquid crystal display device to which this invention is applied.

Referring to the drawings, there will be explained an active-matrix type liquid crystal display device adjustment method of this invention.

This active-matrix type liquid crystal display device is a normally-white mode light transmission type liquid crystal display device. This is provided with a 6-inch diagonal display area and color display features.

Various reversal drive methods may be adapted for this active-matrix type liquid crystal display device to display a monotone (raster) image. The vertical scanning line (frame) reversal drive is carried out to reverse the polarity of image signal voltage applied to signal lines with respect to image signal reference voltages every vertical scanning period.

The horizontal scanning line reversal drive is also provided to reverse the polarity of an image signal voltage applied to the signal lines with respect to the image signal reference voltage every single horizontal pixel line.

Further, the common reversal drive is adapted to reverse the polarity of counter electrode voltage with respect to counter electrode reference voltage in response to polarity reversal of image signal voltage to reduce the signal amplitude.

As shown in FIG. 1, this active-matrix type liquid crystal display device 1 includes liquid crystal panel 100, X-driver 500 and Y-driver 600 which which drive liquid crystal panel 100, and counter electrode drive circuit 700.

Figure 3:
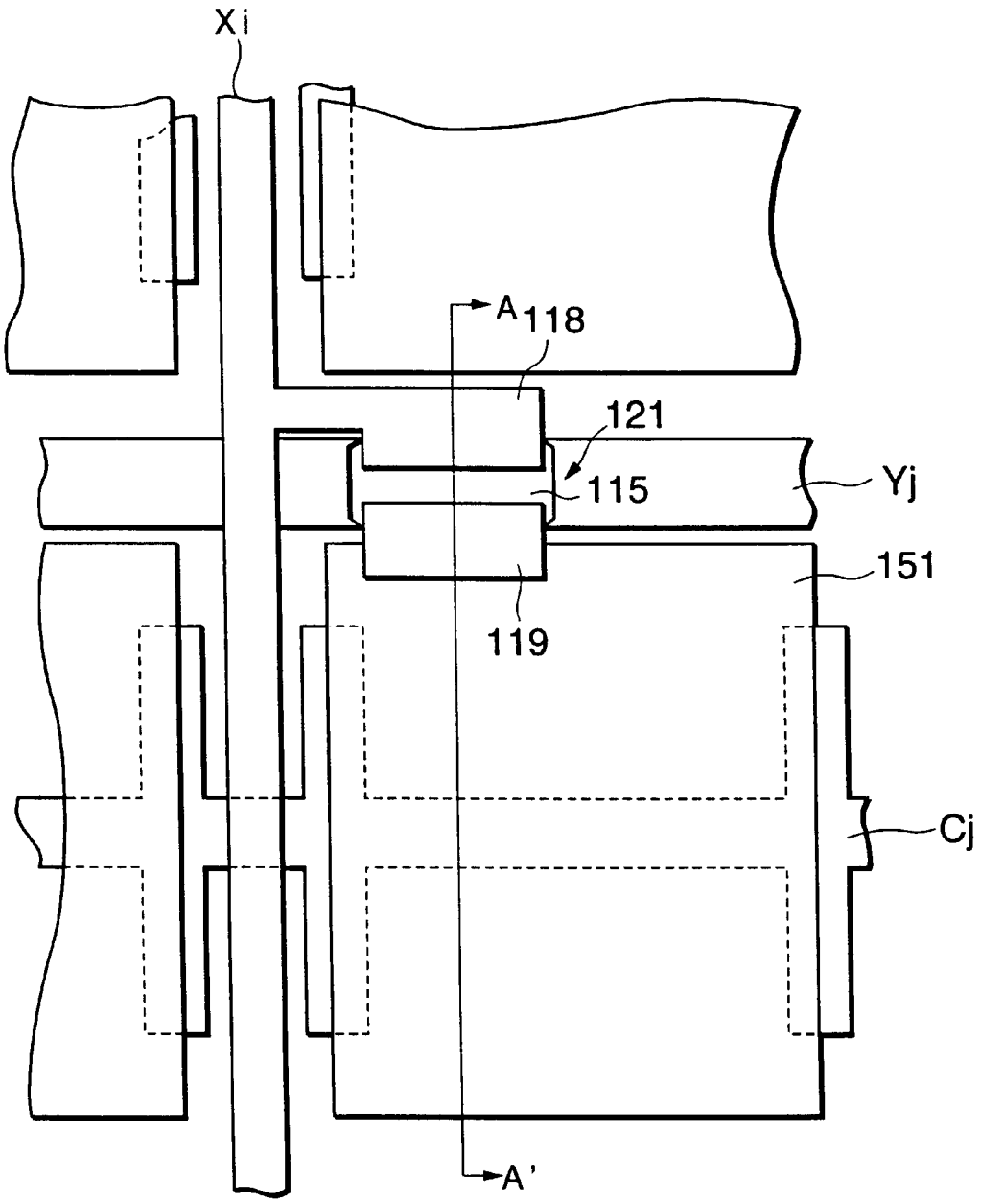
FIG. 3 is a partial front view of the array substrate of the active-matrix type liquid crystal display device in FIG. 1.
Figure 4:
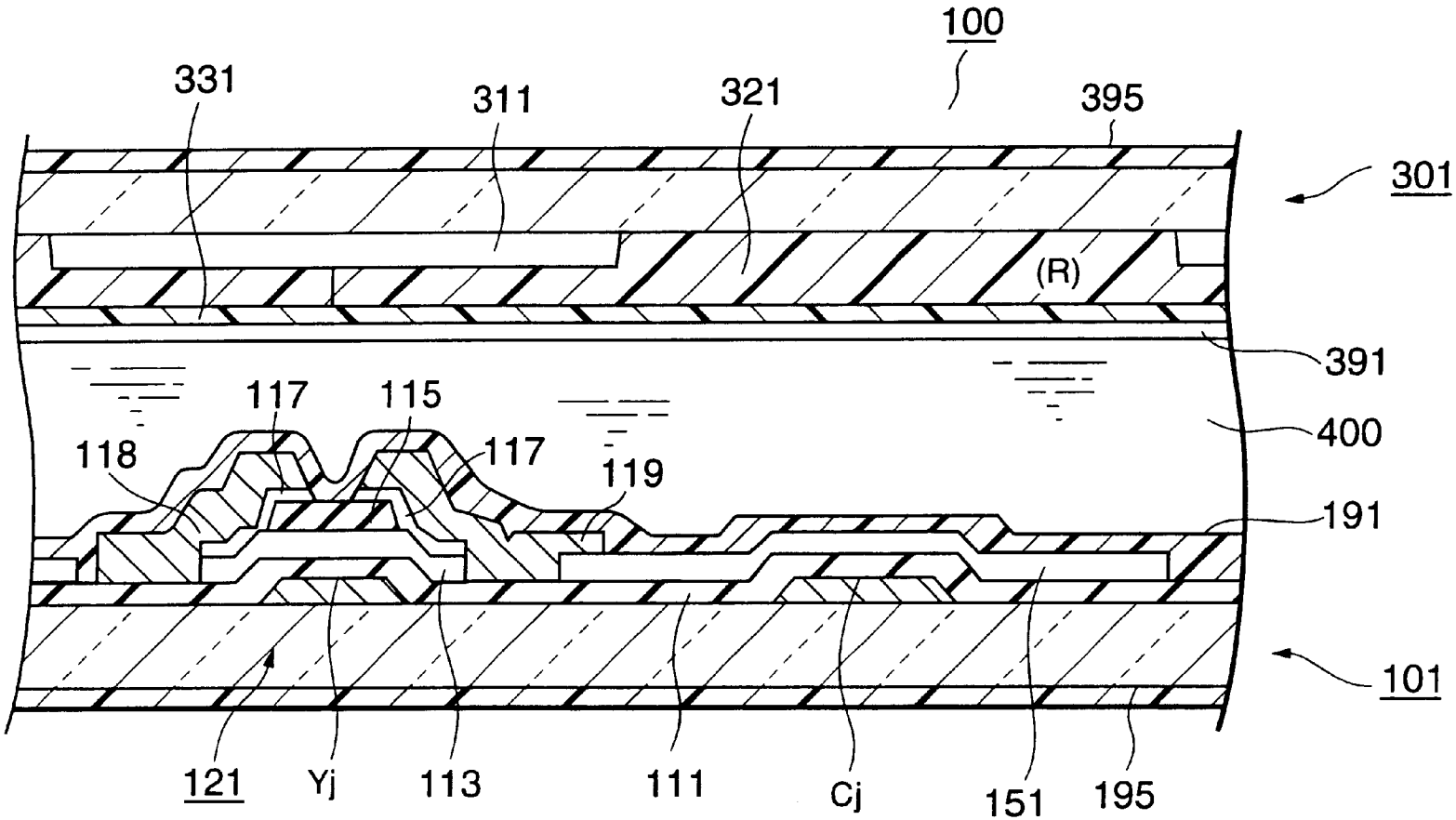
FIG. 4 is a cross-sectional view of the liquid crystal panel cut along the line A–A' in FIG. 3.

As shown in FIGS. 3 and 4, liquid crystal panel 100 has an array substrate 101 and a counter substrate 301 which hold twisted nematic type liquid crystal layer 400 through respective alignment films 191 and 391, and is hermetically sealed at the edges thereof by a sealing agent (not illustrated).

Polarizers 195 and 395 are positioned on the outer surfaces of each substrate 101 and 301 so that their axes of polarization are orthogonal to each other. However, if a polymer dispersion type liquid crystal made frame a mixed system of transparent resin and liquid crystal material is used as liquid crystal layer 400, there will be no requirement for special alignment films or polarizers.

In array substrate 101, 320×3 signal lines Xi (i=1, 2, . . . , 960) and 240 scanning lines Yj (j=1, 2, . . . , 240) are arranged so that they are orthogonal to each other. Each pixel electrode 151 is composed of ITO (Indium Tin Oxide) as a transparent conductive film. There is provided an inverted staggered stagger structure TFT 121 in the vicinity of a crossing point of each signal line Xi and each scanning line Yj.

A part of scanning line Yj is a gate electrode of TFT 121. It is provided with gate insulation film 111 composed of silicon nitride on scanning line Yj, active layer 113 carposed of a non-crystalline silicon thin film a-Si:H on gate insulation film 111, and channel protective film 115 on active layer 113.

Then, its drain electrode 118 extended from signal line Xi is connected through n+ type a-Si:H ohmic contact layer 117 to a-Si:H. Its source electrode 119 is connected to a-Si:H through another n+ type a-Si:H ohmic contact layer 117. The TFT functions as a switching element to be describe hereinbelow in detail.

The reverse stagger structure TFT 121 applying an a-Si film to active layer 113 is shown as one embodiment of the invention but a stagger structure TFT is also used with an active layer of p-Si or micro-crystal film.

Also, supplementary capacity line Cj is provided in parallel with scanning line Yj and overlaps in part with pixel electrode 151. Supplementary capacitor Cs is formed by pixel electrode 151 and supplementary capacity line Cj. This supplementary capacitor Cs may be formed with a neighboring scanning line Yj−1 in place of capacity line Cj.

As a modification to the present embodiment, pixel and counter electrodes 151 and 331 may be provided on array substrate 101 so as to apply a lateral electric field to the liquid crystal layer.

Counter substrate 301 has a glass substrate, color filter layers 321, composed of three primary colors red R, green G and blue B, and light blocking layers 311 arranged between color filter layers 321. Light blocking layers 311 are provided in a matrix to prevent incident light from reaching TFT 121, the gaps between signal lines Xi and pixel electrodes 151, and the gaps between scanning lines Yj and pixel electrodes 151 formed on array substrate 101. Moreover, counter electrodes 331 made of ITO are also positioned underneath color filter layers 321.

The display area of liquid crystal display device 1 formed in this way is composed of 240 horizontal pixel lines, each of which has (320×3) display pixels as 320 display triads.

Referring to FIG. 1, a driving circuit unit will be described hereinbelow. There is provided X-driver 500 which has 960-stage shift register SR1, sampling circuit SP, latch circuit LA and polarity reverse circuit PR. 960-stage shift register SR1 sequentially shifts horizontal start signal HST in response to horizontal clock signal HCK.

Sampling circuit SP sequentially samples analog video signals VR, VG, and VB from three analog video signal supply lines LR, LG and LB in accordance with the outputs of each stage of shift register SR1. Latch circuit LA holds the outputs from sampling circuit SP in response to control signal LS and supplies its outputs to liquid crystal panel 100.

Polarity reversal circuit PR reverses the polarity of analog video signals VR, VS and VB every single horizontal scanning period 1H in response to the horizontal synchronizing signals Hsync and provides its outputs to the analog video signal supply lines LR, LG and LB.

Y-driver 600 has 240-stage shift register SR2 which sequentially shifts vertical start signal VST in response to vertical clock signal VCK.

Figure 2:
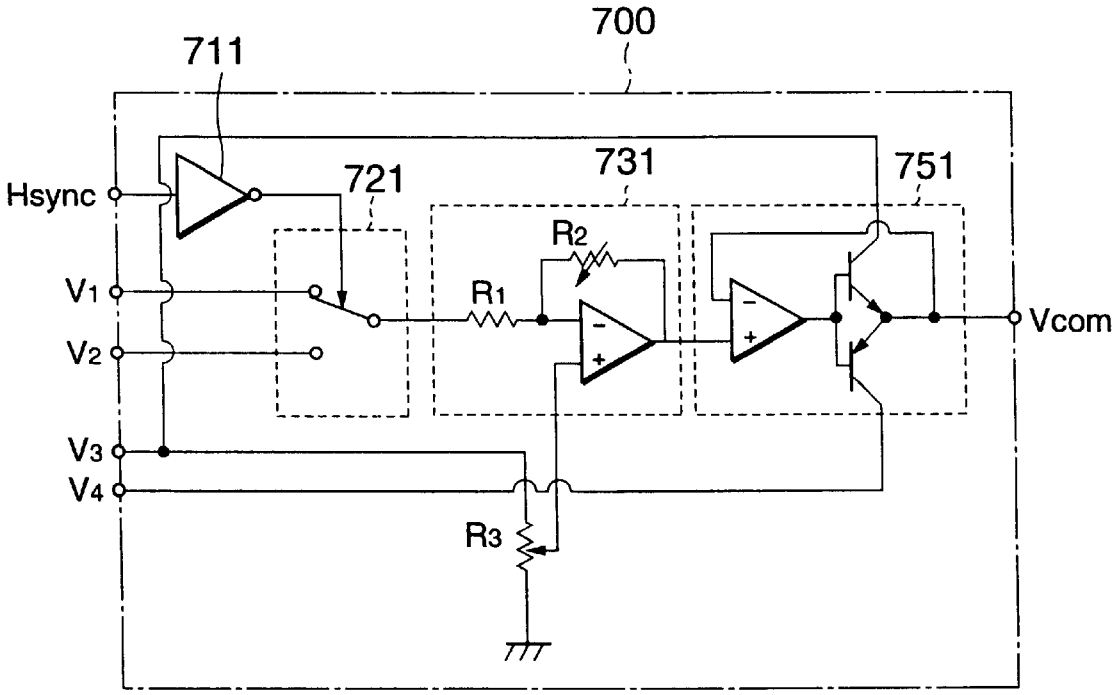
FIG. 2 is a circuit diagram of the counter electrode drive circuit of the active-matrix type liquid crystal display device in FIG. 1.

As shown in FIG. 2, counter electrode drive circuit 700 includes reversal circuit 711 which reverses horizontal synchronizing signal Hsync. Selection circuit 721 is also provided to alternatively select 1st voltage V1 and 2nd voltage V2, which are 5V and 0V, respectively, every single horizontal scanning period 1H in response to the output of reversal circuit 711.

Potential divider circuit 731 is further provided and includes an operational amplifier, and 1st resistor R1 and 2nd resistor R2 to set the amplitude of the square wave voltage from selection circuit 721 by resistance ratio [R2/(R1+R2)]. 3rd resistor R3 is inserted between 3rd voltage line V3 and the ground potential so that a variable output is supplied to the operational amplifier as a reference potential.

Output voltage adjusting circuit 751 is connected to potential divider circuit 731. Output voltage adjuster 751 takes the output voltage of potential divider circuit 731 as its gate voltage and provides the rectangular waveform voltage to be set between 7V and −5V of 3rd and 4th voltage lines V3 and V4, respectively.

With the above construction, active-matrix type liquid crystal display device 1 operates in the following way.

Figure 5:
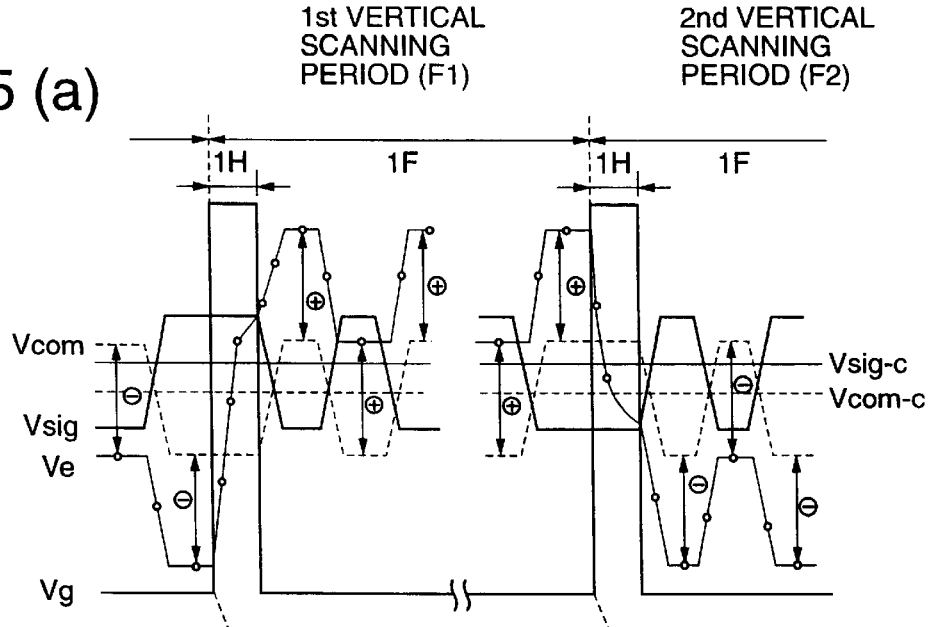
FIGS. 5(*a*) and 5(*b*) show drive waveforms of the active-matrix type liquid crystal display device in FIG. 1.
Figure 5:
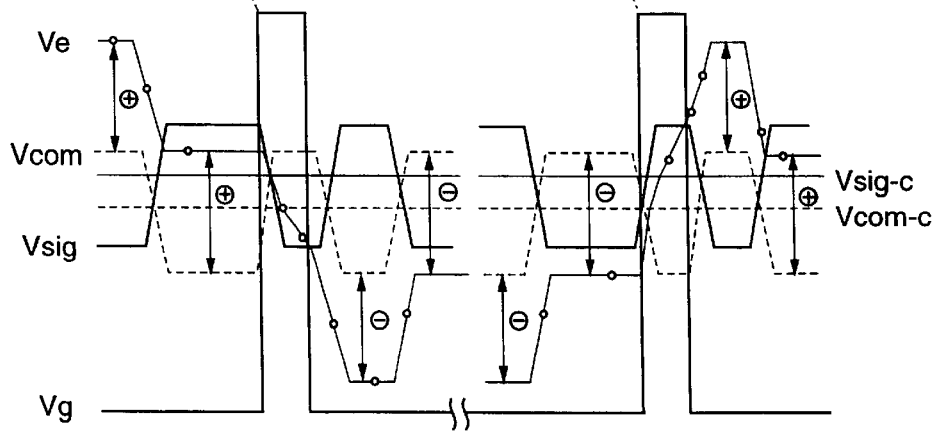

FIGS. 5(*a*) and 5(*b*) show the driving waveforms in the case that a black image is displayed. FIG. 5(*a*) indicates a first display pixel of the first horizontal pixel line L1, and FIG. 5(*b*) shows a first display pixel of the second horizontal pixel line L2.

In this case, image signal voltage Vsig and counter electrode voltage Vcom are in the opposite phase with each other and reverse the polarities thereof with respect to reference potentials Vsig-c and Vcom-c every single horizontal scanning period, respectively.

During first vertical scanning period F1, scanning pulse Vg is supplied to scanning line Y1 for first horizontal pixel line L1. TFT 121 for the first display pixel of first horizontal pixel line L1 is turned on in response to scanning pulse Vg so that image voltage Vsig is applied to pixel electrode E of the liquid crystal layer through the TFT 121 (see also FIGS. 1, 15(*a*), 15(*b*) and 18).

Potential difference between pixel electrode voltage Ve, which gradually reaches image signal voltage Vsig because of a certain time constant in the circuit, and counter electrode voltage Vcom is positive in polarity and is high enough in amplitude for the pixel to display a black image. Such potential difference is stored in equivalent liquid crystal capacitor Clc until the TFT 121 is turned on in response to a next horizontal scanning pulse even after the TFT 121 has been turned off in response to the present horizontal scanning pulse Vg.

When scanning pulse Vg is supplied to scanning line Yr during second vertical scanning period F2, the TFT 121 is again turned on so that image signal voltage Vsig is applied to pixel electrode E of the liquid crystal layer through the TFT 121.

In this case, however, pixel electrode voltage Ve and counter electrode voltage Vcom are in the reversedphase to those for first vertical scanning period F1. The potential thereof difference is, therefore, negative in polarity but still high enough in amplitude for the pixel to display a black image. It is also stored in capacitor Clc until the TFT 121 is turned on in response to a next horizontal scanning pulse even after the TFT 121 has been turned off in response to the present horizontal scanning pulse Vg.

The first display pixel of second horizontal pixel line L2 operates substantially in the same way as shown in FIG. 5(*a*). When scanning pulse Vg is supplied to scanning line Y2 for second horizontal pixel line L2 during first vertical scanning period F1, TFT 121 for the pixel in second horizontal pixel line L2 is turned on and image voltage Vsig is applied to pixel electrode E of the liquid crystal layer through the TFT 121.

As shown in FIG. 5(*b*), potential difference between pixel electrode voltage Vsig and counter electrode Vcom is negative in polarity and is high enough in amplitude for the pixel to display a black image. Such potential difference is stored in equivalent liquid crystal capacitor Clc until the TFT 121 is turned on in response to a next horizontal scanning pulse even after the TFT 121 has been turned off in response to the present horizontal scanning pulse Vg.

When scanning pulse Vg is supplied to scanning line Y2 during second scanning period F2, the TFT 121 is again turned on so that image signal voltage Vsig is applied to pixel electrode E of the liquid crystal layer through the TFT 121.

In this case, however, with respect to reference voltage Vcom-c, pixel electrode voltage Ve and counter electrode voltage Vcom are in the reversed phase to those for first vertical scanning period F1. The potential difference thereof is positive in polarity but still high enough in amplitude for the pixel to display a black image, It is also stored in capacitor Clc until the TFT 121 is turned on in response to a next horizontal pulse even after the TFT 121 has been turned off in response to the present horizontal scanning pulse Vg.

Figure 6:
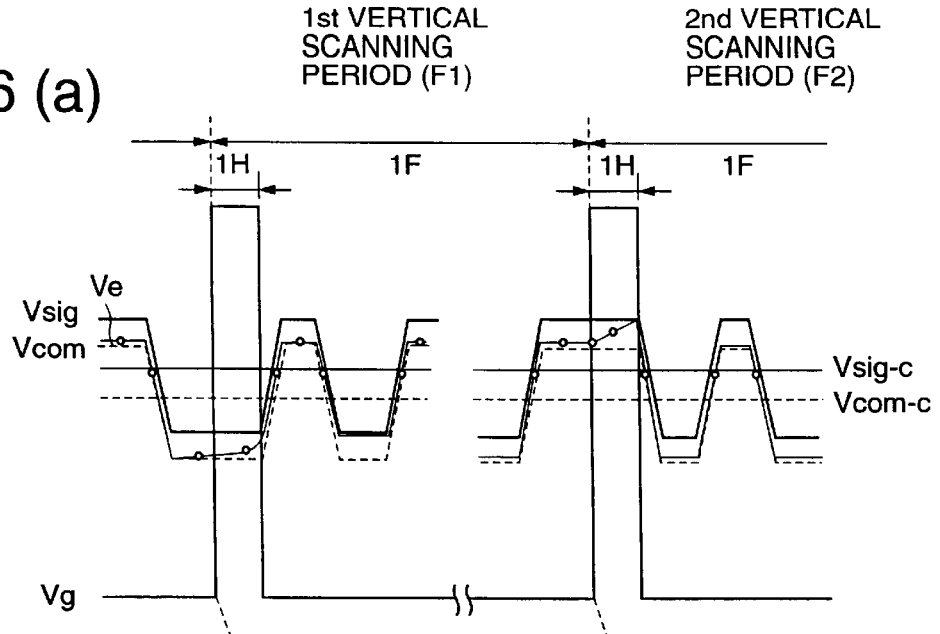
FIGS. 6(*a*) and 6(*b*) show drive waveforms of the active-matrix type liquid crystal display device in FIG. 1.
Figure 6:
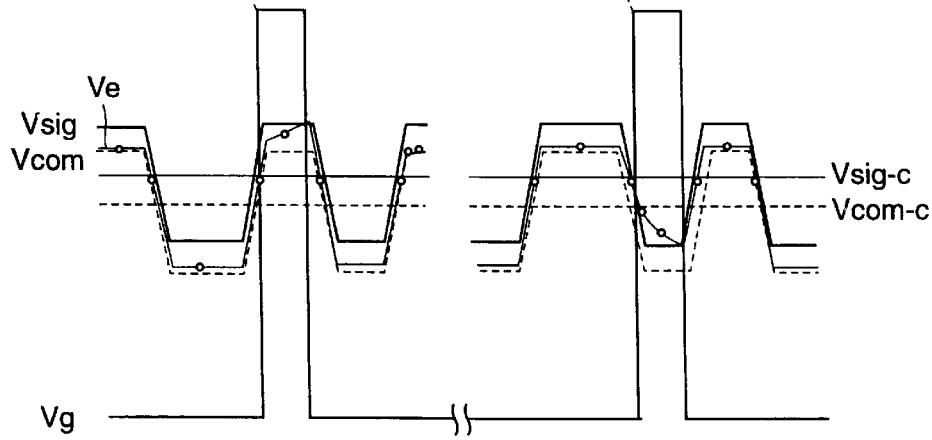

FIGS. 6(*a*) and 6(*b*) show the driving waveforms in the case when a white image is displayed on pixels of the first and second horizontal pixel lines L1 and L2, respectively, in the same way as in FIGS. 5(*a*) and 5(*b*), In this case, image signal voltage Vsig and counter electrode voltage Vcom are in phase but alternate the polarity thereof with respect to reference voltages Vsig-c and Vcom-c every single horizontal scanning period, respectively, except those between last and first horizontal scanning lines.

When scanning pulse Vg is supplied to scanning line Y1 for first horizontal pixel line L1 during first vertical scanning period F1, TFT 121 for a pixel of first horizontal pixel line L1 is turned on so that image signal voltage Vsig is applied to pixel electrode E through the TFT 121.

As a result, pixel electrode voltage Ve becomes slightly higher in amplitude than counter electrode voltage Vcom so that a white image is displayed on the pixel. The potential difference is stored in liquid crystal capacitor Clc until the TFT 121 is turned on in response to a next horizontal pulse even after the TFT 121 has been turned off in response to the present horizontal scanning pulse Vg.

When scanning pulse Vg is supplied to scanning line Y2 for the second horizontal pixel line L2 during a second scanning period F2, the TFT 121 is again turned on so that image signal o voltage Vsig is applied to pixel electrode B of the liquid crystal layer through the TFT 121.

In this case, with respect to the reference voltage Vcom-c, pixel electrode voltage Ve and counter electrode voltage Vcom are in the reversed phase to those for first vertical scanning period F1. The difference (Ve−Vcom) thereof is little in amplitude and stored in liquid crystal capacitor Clc until the TFT 121 is turned on in response to a next horizontal pulse even after the TFT 121 has been turned off in response to the present horizontal scanning pulse Vg.

The white image is displayed on the pixel in second horizontal pixel line L2 during first and second vertical scanning periods F1 and F2.

Since, as described above, H-line reversal drive together with V-line reversal drive are carried out in the active-matrix type liquid crystal display device, it is difficult to visually recognize flicker and a DC component is unavoidably applied between the pixel and counter electrodes.

Figure 7:
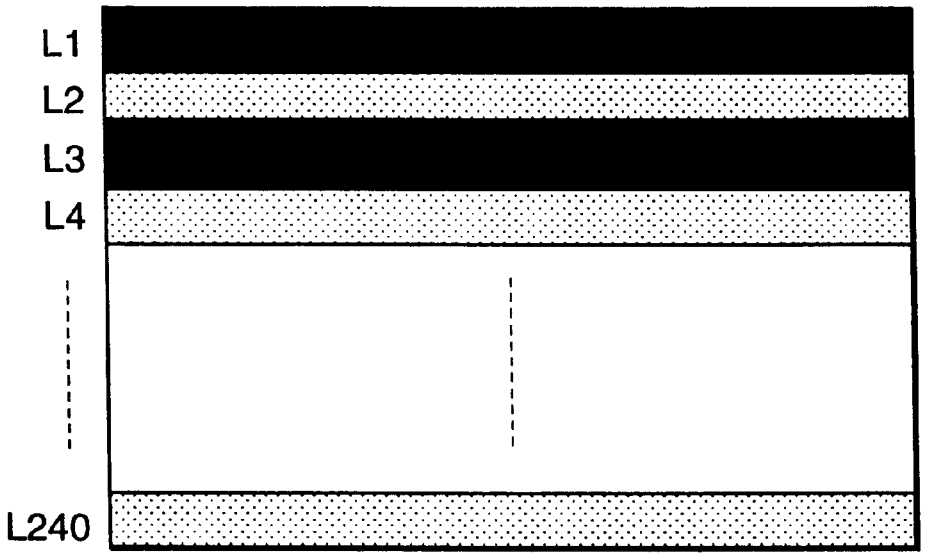
FIG. 7 is a schematic diagram of the display in accordance with a first t of this invention.

To deal with this problem, an adjustment method in accordance with one embodiment of the present invention has such an image display that black and halftone images are displayed on odd numbers of horizontal pixel lines and even numbers of horizontal lines, respectively, as shown in FIG. 7.

Figure 8A:
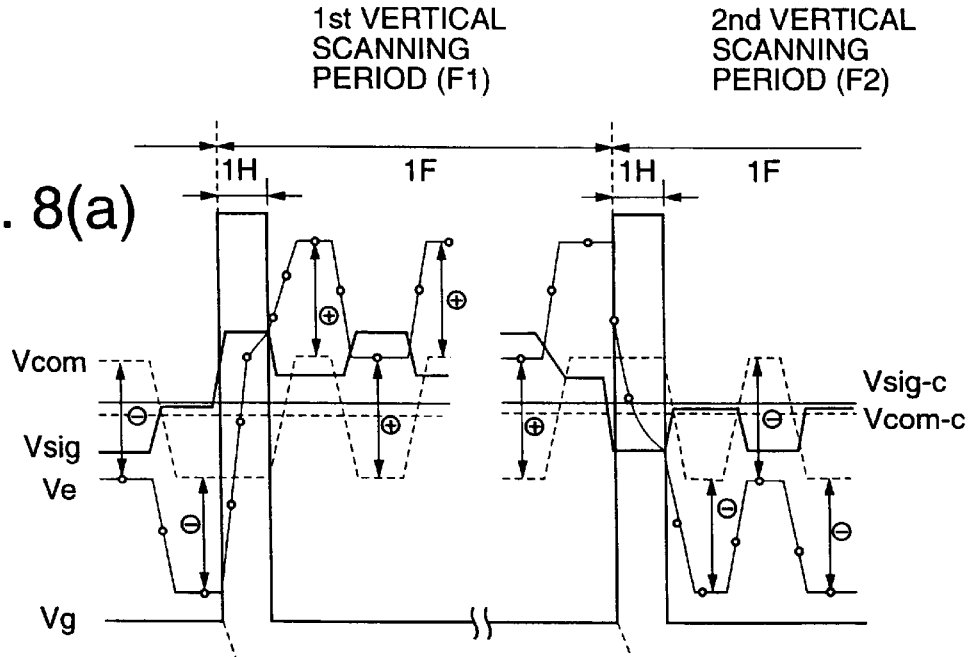
FIGS. 8(*a*) and 8(*b*) show drive waveforms for achieving the display in FIG. 7.
Figure 8B:
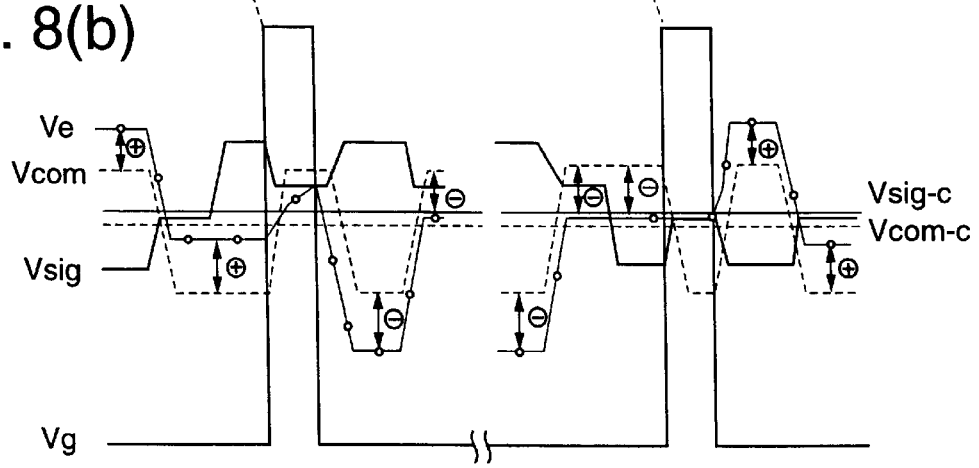

FIGS. 8(*a*) and 8(*b*) show the driving waveforms for achieving the display of such black and halftone images in which FIG. 8(*a*) shows a first display pixel of the first horizontal pixel line L1, and FIG. 8(*b*) shows a first display pixel of second horizontal pixel line L2.

The halftone display in this embodiment is taken as performing a halftone display with relative intensity of 40 when the relative intensity of the minimum brightness (black) display is taken as 0 and that of the maximum brightness (white) display is taken as 100.

When 20-volt scanning pulse Vg is applied to scanning line Y1 for first horizontal pixel line L1 during first vertical scanning period F1, TFT 121 of the first display pixel in the horizontal pixel line L1 is turned on. During first horizontal scanning period (1H) of first vertical scanning period F1, a 6-volt image signal voltage Vsig is applied to pixel electrode E of the liquid crystal layer while the counter electrode voltage Vcom is 0-volt.

When the TFT 121 is turned off in response to pulse voltage Vg, the potential difference between pixel electrode voltage and the counter electrode voltage becomes 5-volt due to 1-volt level shift of parasitic capacitor Cgs and is stored in liquid crystal capacitor Clc until the TFT 121 is turned on in response to a next horizontal pulse even after the TFT 121 has been turned off in response to the present horizontal scanning pulse Vg. As a result, a black image is displayed on the pixel.

When 20-volt scanning pulse Vg is supplied to the scanning line Y1 during second vertical scanning period F2, the TFT 121 is again turned on. In this particular case, however, with respect to reference voltages Vcom-c and Vsig-c, counter electrode voltage Vcom and image signal voltage Vsig are in the reversed phase to those for first vertical scanning period F1 as shown in FIG. 8(*a*), respectively.

The potential difference is, therefore, negative in polarity but still high enough in amplitude (5-volt) for the pixel to continuously display the black image.

When 20-volt scanning pulse Vg is supplied to scanning line Y2 for second horizontal pixel line L2 daring first vertical scanning period F1, TFT 121 for the first display pixel in second horizontal pixel line L2 is turned on.

During second horizontal scanning period (1H) of first vertical scanning period F1, a 4-volt image signal voltage Vsig is applied to pixel electrode E of the liquid crystal layer through the TFT 121 while a 5-volt counter electrode voltage Vcom is applied to counter electrode C thereof.

When the TFT 121 is turned off in response to pulse voltage Vg, −2-volt potential difference is stored in liquid crystal capacitor Clc because of 1-volt store in parasitic capacitor Cgs until the TFT 121 is turned on in response to a next horizontal pulse. As a result, a halftone image is display on the pixel in second horizontal pixel line L2 for first vertical period F1.

When 20-volt scanning pulse Vg is supplied to scanning line Y2 during second vertical period F2, the TFT 121 for the pixel in the second horizontal pixel line L2 is again tuned on.

During second horizontal scanning period (1H) of the second vertical scanning period F2, 3-volt image signal voltage Vsig is applied to the pixel electrode E of the liquid crystal layer through the TFT 121 while 0-volt counter electrode voltage is applied to counter electrode C of the liquid crystal layer.

When the TFT 121 is turned off in response to pulse voltage Vg, 2-volt potential difference is stored in liquid crystal capacitor Clc due to 1-volt stored in parasitic capacitor Cgs until the TFT 121 is turned on in response to a next horizontal pulse so that the pixel continuously displays the halftone image.

Although the black (minimum brightness) images are displayed on the odd numbers of horizontal pixel lines L1, L2, L3, . . . , and L239, an operator can visually recognize only the halftone (gray) image displays on the even numbers of horizontal pixel lines L2, L4, L6, . . . , and L240.

The even numbers of horizontal pixel lines have potential differences with the same polarity applied between the pixel and counter electrodes of the liquid crystal layers during each vertical period.

For this reason, in spite of the fact that pixel electrode voltage Ve and counter electrode voltage Vcom are driven to alter the polarity thereof every single horizontal scanning line and the pixel frequency is high, the operator can visually recognize the images as the halftone images only as if the image frequency were substantially reduced.

In the event, for instance, that reference voltage Vcom-c for counter electrode voltage Vcom is set to be lower than its ideal value, a positive potential difference is continuously applied between the pixel and counter electrodes.

The operator can, however, easily detect flicker on the image display of this embodiment and adjust to eliminate it in such a way that the variable resistor R2 of counter electrode driving circuit 700 is set to make reference voltage Vcom-c higher than the present value. It results in avoidance of a DC component applied between the pixel and counter electrodes.

An adjustment method of the present invention is applicable not only to above mentioned embodiment with the specific driving techniques of V-reversal drive, H-reversal drive and common reversal drive but also to other embodiments with any modification thereof, such as modified H-reversal drive techniques in which potential difference is reversed in polarity every multiple of horizontal pixel lines, e.g., every two or three horizontal pixel lines.

Figure 9:
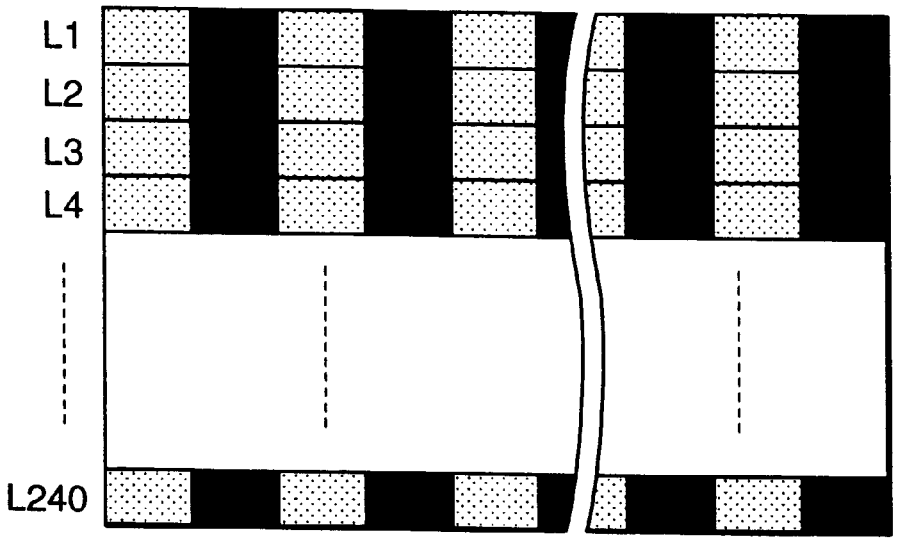
FIG. 9 is a schematic diagram of the display in accordance with a second embodiment of the present invention.

Further, flicker is also easily detectable in the case that, as shown in FIG. 9, black and halftone images are displayed at every vertical pixel line in a V-reversal driven active-matrix type liquid crystal display device, respectively. In this particular case, since counter electrode voltage Vcom is constant, a direct adjustment of the same Vcom leads to a flicker free display to prevent a DC component from being applied to the pixel and counter electrodes for a long time.

Instead of adjusting counter electrode voltage Vcom in the above explained embodiments, image signal reference voltage Vsig-c or a voltage supplied to supplementary capacitor line Cj is also adjustable.

In summery, an adjustment method of the present invention can be carried out by control means of the potential difference between pixel electrode voltage Ve and counter electrode voltage Vcom.

It is desirable, however, to adjust counter electrode voltage Vcom because it does not affect the display image too Another adjustment method of an active-matrix type liquid crystal display device of this invention will be explained with reference to FIGS. 10 through 14. In the figures, the same reference numerals and/or symbols represent substantially the same or similar components as those in the embodiments explained so far.

The active-matrix type liquid crystal display device of this embodiment operates a normally white mode, color display with 12.1-inch diagonal long display area. In the display device, when an identical image is displayed, in the HV-reversal drive potential differences between the pixel and counter electrodes are altered in polarity every pixel in addition to V-reversal drive where those are altered in polarity every vertical scanning period.

Figure 10:
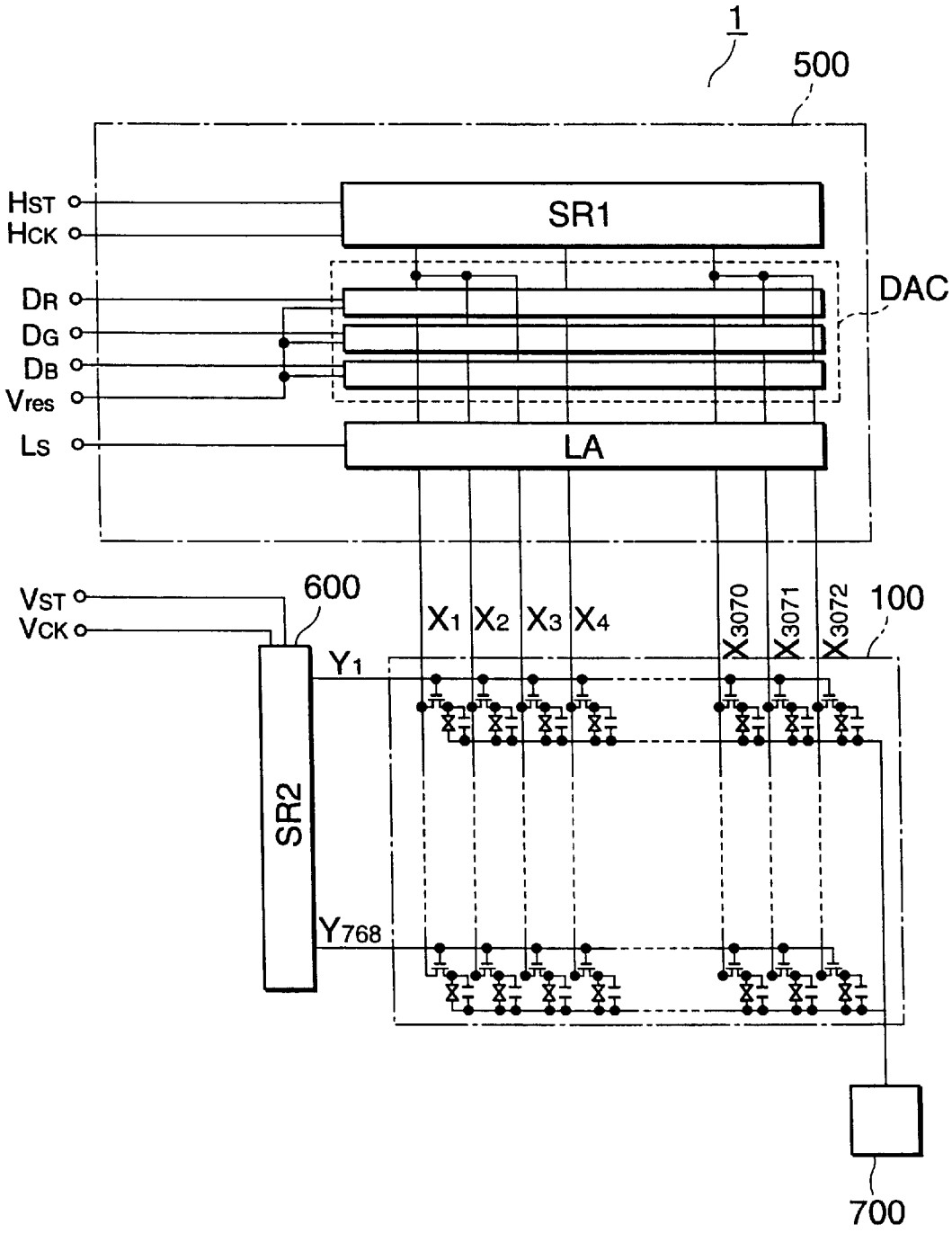
FIG. 10 is a block diagram of another embodiment of the active-matrix type liquid crystal display device to which the present invention is applied.

As shown in FIG. 10, this active-matrix type liquid crystal display device includes a liquid crystal display panel 100, X-driver 500, Y-driver 600 and counter electrode driving circuit 700. The display area has 600 horizontal pixel lines, each of which has (800×3) pixels, i.e., 800 picture elements.

The liquid crystal display panel 100 is the same in construction as the one shown in FIG. 1 except the number of pixels. X-driver 500 has 800-stage shift register SR1 which transfers horizontal start signal HST from one stage to another in response to horizontal clock signal HCK, digital-analog converter (DAC) in which serially provided 8-bit red (R), green (G) and blue (B) digital image data (DR), (DG) and (DB) are converted into analog voltage data, respectively, in serial-parallel fashion in response to output signals from shift register SR1, and latch circuit (LA) which holds output signals from digital-analog converter (DAC) in response to the control signals (LS).

8-bit red (R), green (G) and blue (B) digital image data (DR), (DG) and (DB) are altered in polarity at every pixel. Y-driver 600 has 600-stage shift register which transfers vertical start signal VST in response to the vertical clock signal VCK.

Figure 11:
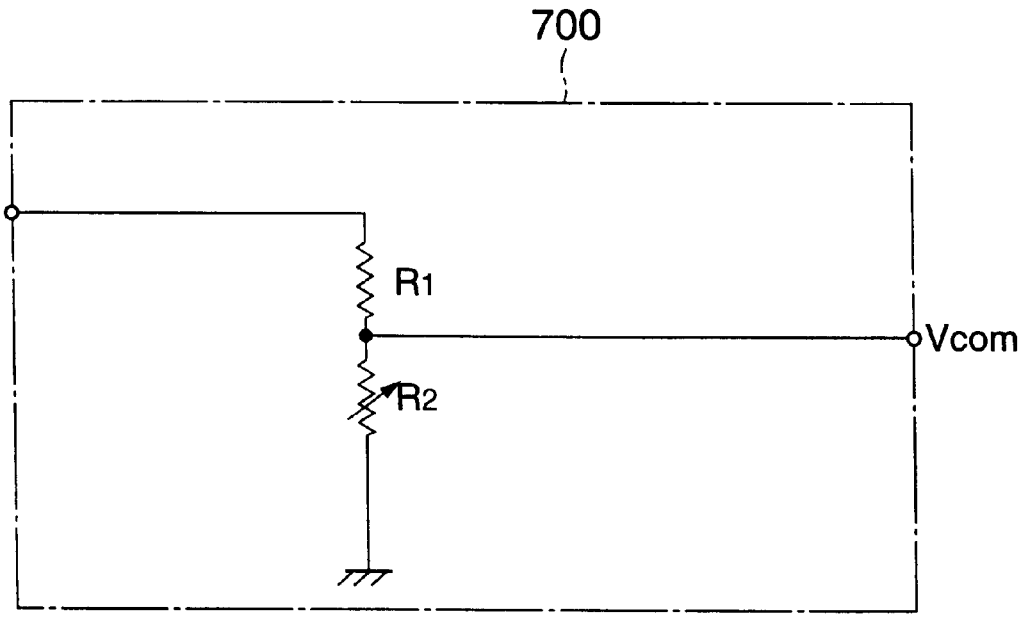
FIG. 11 is a circuit diagram of the counter electrode drive circuit in the device of FIG. 10.

Counter electrode driving circuit 700 has first and second resistors R1 and R2 connected in series with 10-volt first voltage source V1 as shown in FIG. 11. 5-volt constant voltage or a variable voltage by adjustment of resistor R2 is provided to an output terminal as counter electrode voltage Vcom.

Figure 12A:
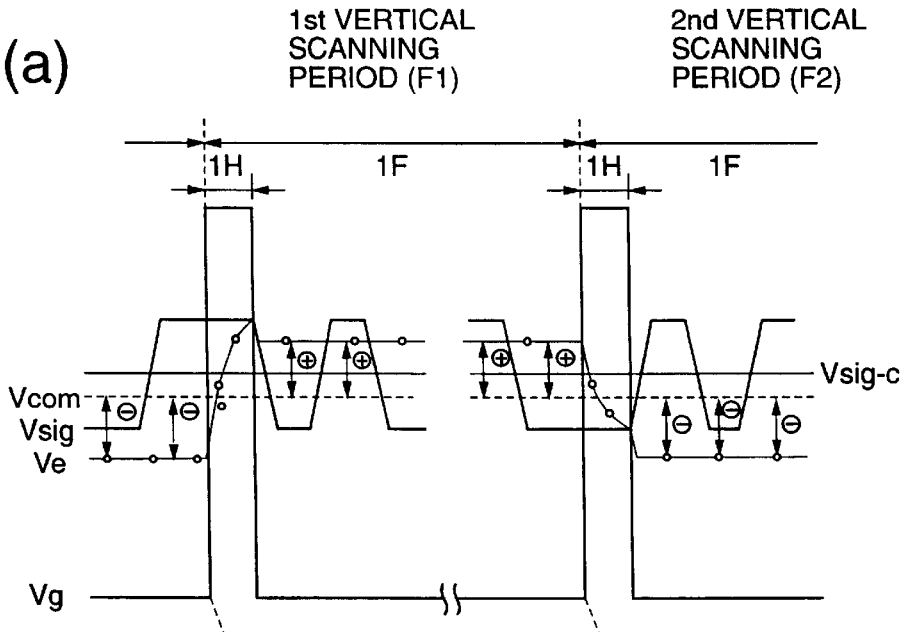
FIGS. 12(*a*) and 12(*b*) are drive waveforms of the display in the device of FIG. 10.
Figure 12B:
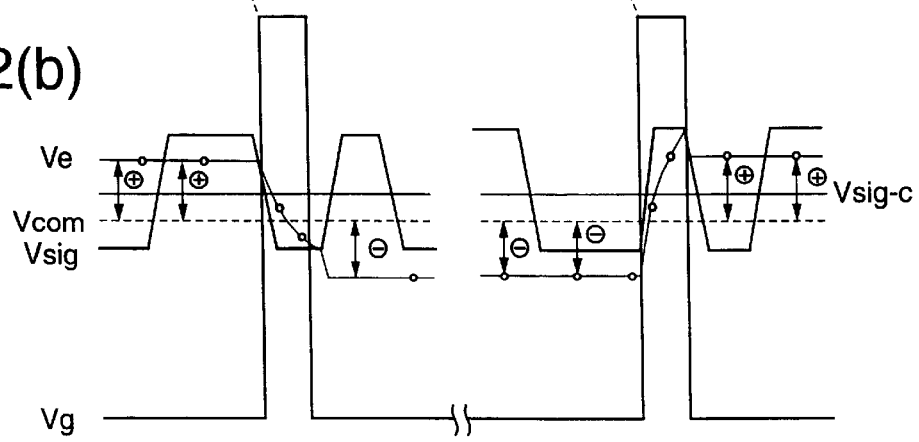

This active-matrix type liquid crystal display device 1 operates as follows:

Driving waveforms to display black images are shown in FIGS. 12(*a*) and 12(*b*) in which FIG. 12(*a*) shows driving waveforms applied to a first display pixel of first horizontal pixel line L1 and FIG. 12(*b*) shows those applied to a first display pixel of neighboring second horizontal pixel line L2.

Such first display pixels of first and second horizontal pixel lines L1 and L2 are connected to the same signal line. Counter electrode voltage Vcom is set to be 5-volt and image signal voltage Vsig is altered in polarity with respect to reference voltage Vsig-c every horizontal scanning period.

When scanning pulse Vg is applied to scanning line Y1 for first horizontal pixel line L1 during first vertical scanning period F1, TFT 121 of the first display pixel in the horizontal pixel line L1 is turned on. During first horizontal scanning period (1H) of first vertical scanning period F1, 11-volt image signal voltage Vsig is applied to pixel electrode E of the liquid crystal layer while counter electrode voltage Vcom is 5-volt during the horizontal scanning period (1H).

When the TFT 121 is turned off in response to pulse voltage Vg, the potential difference between pixel electrode voltage and counter electrode voltage becomes 5-volt due to 1-volt stored in parasitic capacitor Cgs and is stored in liquid crystal capacitor Clc until the TFT 121 is turned on in response to a next horizontal pulse. As a result, a black image is displayed on the pixel in accordance with the potential difference.

Similarly, daring horizontal scanning period (1H) of a second vertical scanning period F2, 1-volt image signal voltage and 5-volt counter electrode voltage are applied to pixel and counter electrodes E and C of the liquid crystal layer, respectively.

When the TFT 121 is turned off in response to the scanning pulse Vg, −5-volt potential difference between counter electrode voltage Vcom and pixel electrode voltage Ve is stored due to a 1-volt level shift of parasitic capacitor Cgs until the TFT 121 is turned on in response to a next horizontal pulse. The black image is still displayed on the pixel based upon the potential difference.

When the scanning pulse Vg is provided to scanning line Y2 for the second horizontal pixel line L2 daring first vertical scanning period F1, TFT 121 for the first display pixel in second horizontal pixel line L2 is turned on. During the second horizontal scanning period (1H) of first vertical period F1, 1-volt image signal voltage Vsig is applied to pixel electrode E of the liquid crystal layer through the TFT 121 while 5-volt counter electrode voltage Vcom is applied to counter electrode C thereof.

When the TFT 121 is then turned off in response to pulse voltage Vg, −5-volt potential difference is stored in liquid crystal capacitor Clc because of a 1-volt level shift of parasitic capacitor Cgs until the TFT 121 is turned on in response to a next horizontal pulse. As a result, a black image is displayed on the pixel in the second horizontal pixel line L2 for the first vertical period F1.

When scanning pulse Vg is supplied to scanning line Y2 during the second vertical period F2, the TFT 121 for the pixel in second horizontal pixel line L2 is again tuned on. During second horizontal scanning period (1H) of second vertical scanning period, 11-volt image signal voltage Vsig is applied to pixel electrode E of the liquid crystal layer through the TFT 121 while 5-volt counter electrode voltage is applied to counter electrode C of the liquid crystal layer. When the TFT 121 is turned off in response to pulse voltage Vg, 5-volt potential difference is stored in liquid crystal capacitor Clc due to 1-volt level shift of parasitic capacitor Cgs until the TFT 121 is turned on in response to a next horizontal pulse even after the TFT 121 has been turned off in response to the present horizontal scanning pulse Vg so that the pixel continuously displays the black image.

Although a white image display operation is omitted from the descriptions for the sake of simplicity, the active-matrix type liquid crystal display device 1 displays a combination of black and white images. The potential difference between pixel electrode voltage Ve and counter electrode voltage Vcom is altered in polarity every neighboring pixel, it is quite difficult to visually recognize flickering on the display.

Figure 13:
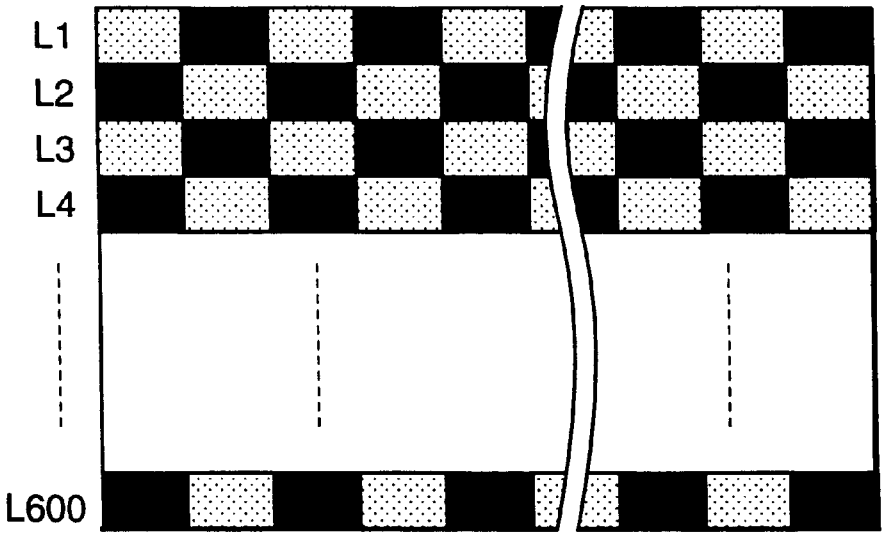
FIG. 13 is a schematic diagram of the display in accordance with a third embodiment of the present invention.

In the present invention, black and halftone images are displayed in which a black image is displayed on one group of pixels during a vertical scanning period for which the potential difference between the pixel and counter electrodes is in the sane polarity and a halftone image is displayed on another group of pixels during the same vertical scanning period for which the potential difference is in the same polarity. In short, an alternative display of black and halftone images in every pixel is carried out as shown in FIG. 13 according to the adjustment method of the present invention.

Figure 14A:
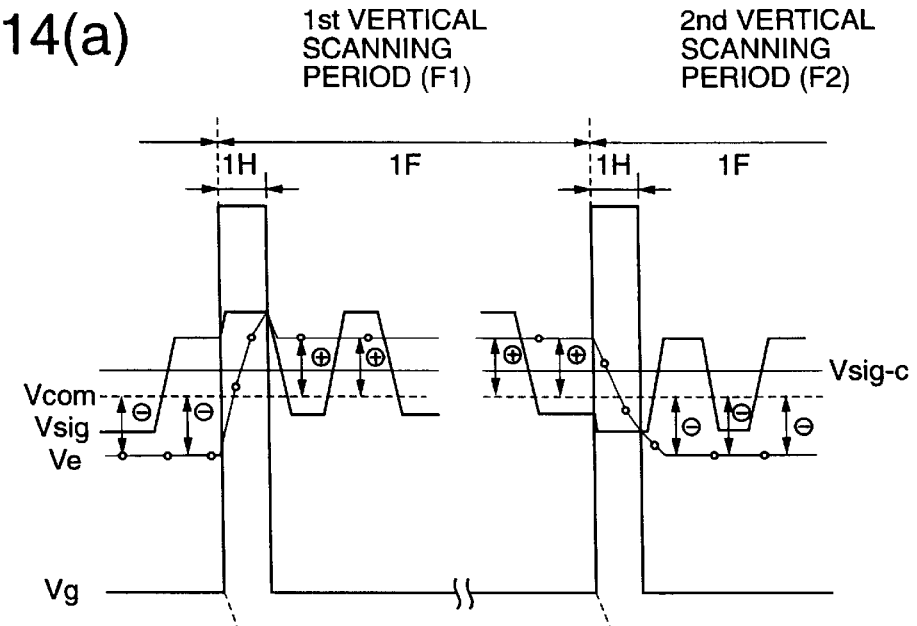
FIGS. 14(*a*) and 14(*b*) are drive waveforms for achieving the display of FIG. 13.
Figure 14B:
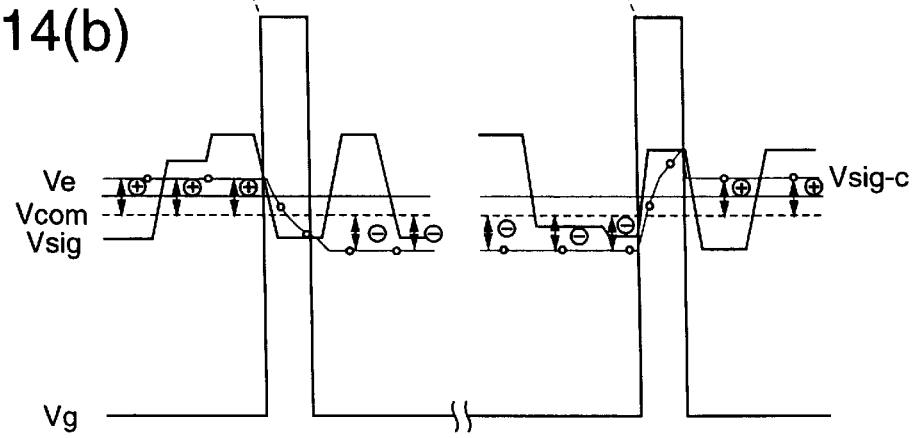
Figure 18:
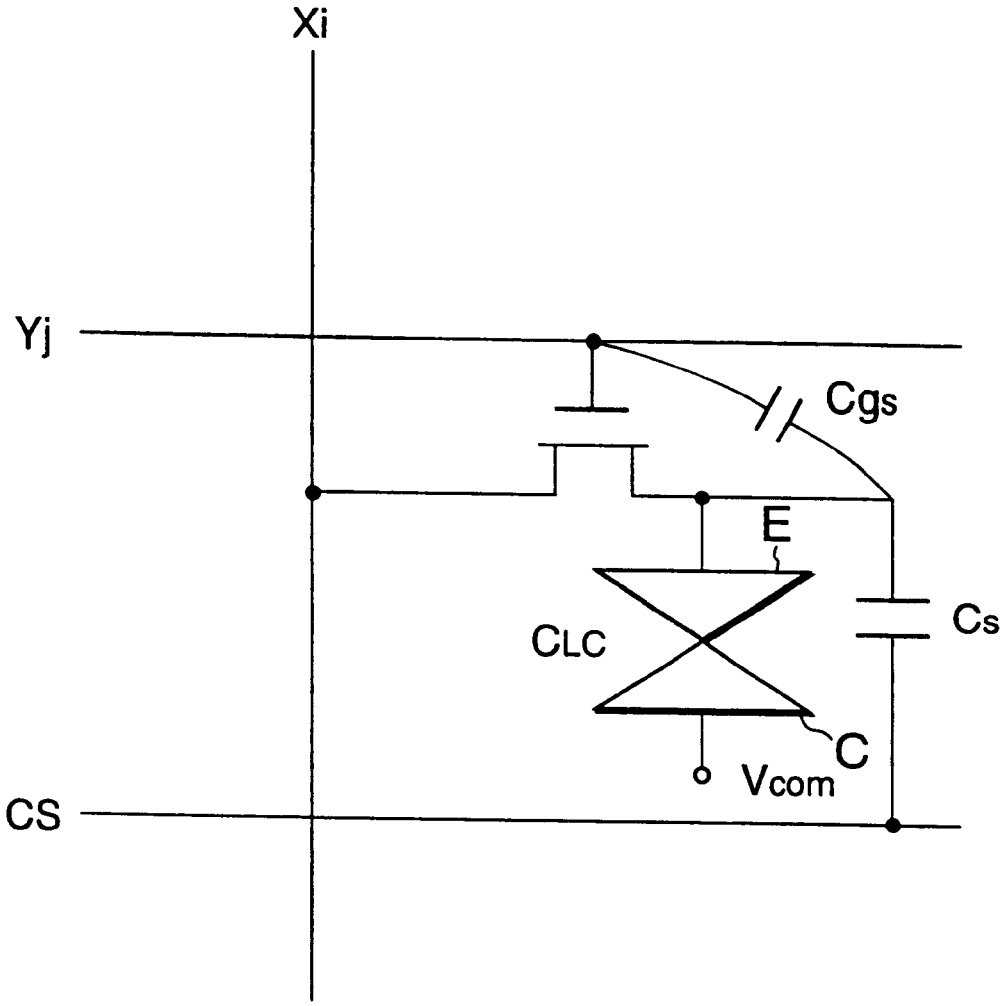
FIG. 18 PRIOR ART
FIG. 18 is an equivalent circuit diagram for each pixel in an active-matrix type liquid crystal display device.
Figure 19:
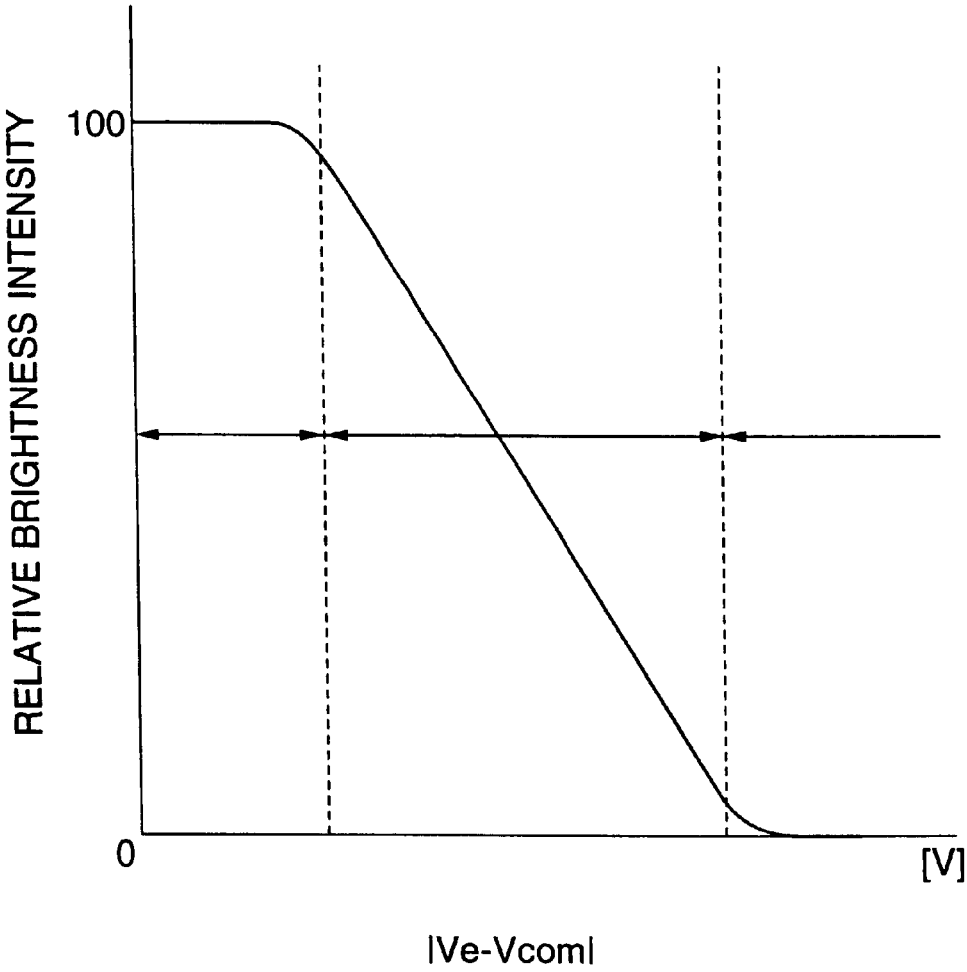
FIG. 19 is voltage-brightness characteristics of the liquid crystal layer in the active-matrix type liquid crystal display device.

There are shown driving waveforms to display black images in FIGS. 14(*a*) and 14(*b*) in which FIG. 14(*a*) shows driving waveforms applied to a first display pixel of a first horizontal pixel line L1 and FIG. 14(*b*) shows those applied to a first display pixel of neighboring second horizontal pixel line L2.

Such first display pixels of first and second horizontal pixel lines L1 and L2 are connected to the same signal line. A halftone image, e.g., a gray image of this embodiment is 40 in relative intensity of brightness on such conditions that black and white images are 0 and 100 in relative intensity of brightness , respectively. Counter electrode voltage Vcom is set to be 5-volt and image signal voltage Vsig is altered in polarity every horizontal scanning period.

When 20-volt scanning pulse Vg is applied to a scanning line Y1 for a first horizontal pixel line L1 during first vertical scanning period F1, TFT 121 of a pixel in the horizontal pixel line L1 is turned on. During first horizontal scanning period (1H) of first vertical scanning period F1, 11-volt image signal voltage Vsig is applied to the pixel electrode B of the liquid crystal layer while counter electrode voltage Vcom is 5-volt during the horizontal scanning period (1H).

When the TFT 121 is turned off in response to pulse voltage Vg, the potential difference between pixel electrode voltage and counter electrode voltage becomes 5-volt due to 1-volt level shift of parasitic capacitor Cgs and is stored in liquid crystal capacitor Clc until the TFT 121 is turned on in response to a next horizontal pulse. As a result, a black image is displayed on the pixel in accordance with the potential difference.

Similarly, during the horizontal scanning period (1H) of second vertical scanning period F2, 1-volt image signal voltage and 5-volt counter electrode voltage are applied to pixel and counter electrodes E and C of the liquid crystal layer, respectively. When the TFT 121 is turned off in response to the scanning pulse Vg, −5-volt potential difference between counter electrode voltage Vcom and pixel electrode voltage Ve is stored due to a 1-volt level shift of parasitic capacitor Cgs until the TFT 121 is turned on in response to a next horizontal pulse and the black image is still displayed on the pixel.

When the scanning pulse Vg is supplied to scanning line Y2 for the second horizontal pixel line L2 during first vertical scanning period F1, TFT 121 for a pixel in second horizontal pixel line L2 is turned on. During the second horizontal scanning period (1H) of first vertical period F1, 4-volt image signal voltage Vsig is applied to pixel electrode E of the liquid crystal layer through the TFT 121 while 5-volt counter electrode voltage Vcom is applied to counter electrode C thereof.

When the TFT 121 is then turned off in response to pulse voltage Vg, −2-volt potential difference is stored in liquid crystal capacitor Clc because of a 1-volt level shift of parasitic capacitor Cgs until the TFT 121 is turned on in response to a next horizontal pulse. As a result, a gray image is displayed on the pixel in the second horizontal pixel line L2 for the first vertical period F1.

When the scanning pulse Vg is supplied to scanning line Y2 during the second vertical period F2, the TFT 121 for the pixel in second horizontal pixel line L2 is again tuned on. During second horizontal scanning period (1H) of second vertical scanning period, 8-volt image signal voltage Vsig is applied to pixel electrode E of the liquid crystal layer through the TFT 121 while 5-volt counter electrode voltage is applied to counter electrode C of the liquid crystal layer.

When the TFT 121 is turned off in response to pulse voltage Vg, 2-volt potential difference is stored in liquid crystal capacitor Clc due to 1-volt level shift of parasitic capacitor Cgs until the TFT 121 is turned on in response to a next horizontal pulse so that the pixel continuously displays the gray image.

Although the black images are displayed on such a group of pixels, an operator can visually recognize only the gray image displays on the remaining group of pixels. The latter group of pixels have potential differences with the same polarity applied between the pixel and counter electrodes of the liquid crystal layers during each vertical scanning period.

For this reason, despite the fact that the potential difference between the pixel electrode voltage Ve and counter electrode voltage Vcom is altered in polarity at every single pixel, the operator can visually recognize the images as the gray (intermediate brightness) images only as if the image frequency were reduced substantially in such a way that the potential difference is in the same polarity during each vertical scanning period. In short, the halftone image display is visually recognized as if the image frequency were reduced.

In the event, for instance, that counter electrode voltage Vcom is not appropriate, a positive or negative potential difference is continuously applied between the pixel and counter electrodes. The operator can, however, easily detect flickering on the image display of this embodiment and adjust to eliminate it in such a way that the variable resistor R2 of the counter electrode driving circuit 700 is set to make the voltage Vcom proper. It results in avoidance of a DC component applied between the pixel and counter electrodes.

An adjustment method of the present invention is applicable not only to the above mentioned embodiments with the specific drives, but also to other embodiments with any modification thereof. Even in the case, for instance, that potential difference of picture elements of red (R), green (G) and blue (B) are different in polarity from each other, an operator can adjust to eliminate flickering on the display in the same way as mentioned above and avoid the application of a DC component to the liquid crystal layer if a black image is displayed on a group of pixels in which the potential difference a between the pixel and counter electrodes is in the same polarity during each vertical scanning period and a halftone image is displayed on another group of pixels in which the potential difference between them is in the same polarity during the vertical scanning period.

Instead of adjusting the counter electrode voltage Vcom in the above explained embodiments, image signal reference voltage Vsig-c or a voltage supplied to supplementary capacitor line Cj is also adjustable.

The present invention is also applicable to an active matrix, reflective type liquid crystal display device.

In summary, the adjustment method of the present invention can be carried out by control means of potential difference between pixel electrode voltage Ve and counter electrode voltage Vcom. It is desirable, however, to adjust counter electrode voltage Vcom because it does not affect a display image too much.

Although, in the embodiments set forth above, an operator visually detects flicker and adjust certain voltages to suppress it, optical equipment may be used to caries out the same operation.

When using the matrix type display device adjustment method of this invention, the application over a long period of a DC voltage on the liquid crystal layer is prevented and, by this means, variation of life span from product to product can be reduced.

What we claim is:

1. An adjustment method for an active-matrix type liquid crystal display device comprising the steps of:

displaying images in pixels provided in a matrix of rows and columns of a display panel with an intensity variable between first and second brightness in accordance with a potential difference applied to liquid crystal layers through pixel and counter electrodes of said pixels, said first brightness being less in intensity than said second brightness;

changing polarities of said potential differences every pixel or every multiple of pixels in at least one vertical scanning period;

applying to said liquid crystal layers of a first group of said pixels said potential difference with the intensity of said first or second brightness and the same polarity during the vertical scanning period;

setting said potential difference with the intensity of a third brightness and the same polarity on the second group of said pixels during the vertical scaring period; and adjusting said potential difference in accordance with said images of at least said third brightness which is intermediate in intensity between said first and second brightness thereby to reduce direct current components of said potential difference applied to said liquid crystal layers.

2. The adjustment method according to claim 1, wherein said adjusting step adjusts said potential difference to sustantially eliminate flickering from said images.

3. The adjustment method according to claim 1 wherein in said changing step the polarity of said potential differences is changed every multiple of vertical scanning periods.

4. The adjustment method according to claim 1, wherein said display panel includes array and counter substrates, said array substrate having said pixel electrodes, switching elements, signal and scanning lines connected said pixel electrodes through said switching elements, said counter substrates having counter electrodes opposite to said array substrates.

5. The adjustment method according to claim 1, wherein in said adjusting step the potential applied to said counter electrodes is adjusted.

6. The adjustment method according to claim 1, wherein said first and second groups of pixels are provided in every row or every multiple of rows.

7. The adjustment method according to claim 1, wherein said first and second groups of said pixels are provided in every column or every multiple of columns.

8. The adjustment method according to claim 1, wherein said first or second groups of pixels are provided in every pixel or every multiple of pixels.

9. The adjustment method according to claim 1, wherein in said setting step the intensity of said third brightness is set in a range from 30 to 70 such that the intensity of said first brightness is 100 while the intensity of said second brightness is 0.

10. The adjustment method according to claim 9, wherein in said setting step the intensity of said third brightness is set in a range from 40 to 50.

11. The adjustment method according to claim 1, wherein in said applying step said first group of pixels are applied said potential difference with the intensity of said first brightness.

12. The adjustment method according to claim 1, wherein aid first group of pixels display white images.

13. The adjustment method according to claim 1, wherein in said applying step said first group of pixels are applied said potential differences with the intensity of said second brightness.

14. An adjustment method for an active-matrix type liquid crystal display device comprising the steps of:

controlling optical transmission of pixels provided in a matrix of rows and columns in a display panel in accordance with potential difference applied to pixel and counter electrodes of said pixels, said optical transmission ranging between first and second transmittance;

changing polarities of said potential difference every pixel or every multiple of pixels during at least one vertical scanning period;

providing a first group of said pixels with the same polarity of said potential difference during at least one vertical scanning period to set the optical transmission of the first group of said pixels to be at said first transmittance;

providing the potential difference to a second group of said pixels with the same polarity of said potential difference during the vertical scanning period to set the optical transmission on the second group of pixels to be a third transmittance between said first and second transmittance; and adjusting said potential differences in accordance with said pixels of at least said third transmittance, thereby to reduce direct current components of said potential difference applied to a liquid crystal layer of said active-matrix type liquid crystal display device.

15. The adjustment method according to claim 14, wherein said pixel and counter electrodes hold liquid crystal layers.

* * * * *

UNITED STATES PATENT AND TRADEMARK OFFICE

CERTIFICATE OF CORRECTION

PATENT NO. : 6,313,818 B1
DATED : November 6, 2001
INVENTOR(S) : Kondo et al.

It is certified that error appears in the above-identified patent and that said Letters Patent is hereby corrected as shown below:

Title page,
Item [30], Foreign Application Priority Data, should read:

-- [30] Foreign Application Priority Data

Jun. 7, 1996 (JP) ..... 8-145354
May 28, 1997 (JP) ..... 9-138075 --

Signed and Sealed this

Eleventh Day of June, 2002

*Attest:*

*Attesting Officer*

JAMES E. ROGAN
*Director of the United States Patent and Trademark Office*